US010138037B2

(12) United States Patent
Migas et al.

(10) Patent No.: US 10,138,037 B2
(45) Date of Patent: Nov. 27, 2018

(54) CLOSURE FOR A PACKAGE

(71) Applicant: Closure Systems International Inc., Indianapolis, IN (US)

(72) Inventors: Jeremiah Migas, Crawfordsville, IN (US); Jeremy Morin, Zionsville, IN (US); Ramesh Kamath, Carmel, IN (US)

(73) Assignee: Closure Systems International Inc., Memphis, TN (US)

( * ) Notice: Subject to any disclaimer, the term of this patent is extended or adjusted under 35 U.S.C. 154(b) by 110 days.

(21) Appl. No.: 15/287,496

(22) Filed: Oct. 6, 2016

(65) Prior Publication Data

US 2018/0099795 A1 Apr. 12, 2018

(51) Int. Cl.
*B65D 53/04* (2006.01)
*B65D 51/14* (2006.01)

(52) U.S. Cl.
CPC ..... *B65D 53/04* (2013.01); *B65D 51/145* (2013.01)

(58) Field of Classification Search
CPC ..... B65D 51/228; B65D 41/34; B65D 1/0246
USPC ..... 215/276, 349, 350
See application file for complete search history.

(56) References Cited

U.S. PATENT DOCUMENTS 2,092,547 A 9/1937 Allenbaugh
3,435,978 A 4/1969 Wittwer
4,497,765 A 2/1985 Wilde
4,694,970 A * 9/1987 Hayes ..... B65D 41/3423 215/252
5,950,850 A 9/1999 Takamatsu
6,123,212 A 9/2000 Russell
6,557,714 B2 5/2003 Babcock
7,611,026 B1 * 11/2009 Bloom ..... B65D 41/045 215/252
7,874,441 B2 1/2011 Bloom
7,942,287 B2 5/2011 King
8,453,866 B2 6/2013 Kamath
8,528,759 B2 9/2013 Pucci
8,695,821 B2 4/2014 Bashyam
8,807,360 B2 8/2014 Erspamer
9,085,395 B2 7/2015 Sadiq
9,126,726 B2 9/2015 Edie
2005/0056613 A1 3/2005 King
2005/0082249 A1 4/2005 King
2005/0284837 A1 * 12/2005 Taber ..... B65D 51/145 215/276
2014/0021157 A1 1/2014 Gren

* cited by examiner

*Primary Examiner* — James N Smalley
(74) *Attorney, Agent, or Firm* — Nixon Peabody LLP

(57) ABSTRACT

A closure includes a polymeric top wall portion, a polymeric liner, a polymeric disc and a polymeric annular skirt portion. The polymeric disc is located between the polymeric top wall portion and the polymeric liner. The polymeric annular skirt portion depends from the polymeric top wall portion. The annular skirt portion includes: (1) an internal thread formation for mating engagement with an external thread formation of a container; and (2) an internal prying projection to assist in removing the closure from the container. At least a portion of the internal prying projection is located nearer the polymeric top wall portion than the internal thread formation.

24 Claims, 7 Drawing Sheets

CLOSURE FOR A PACKAGE

FIELD OF THE INVENTION

The present invention relates generally to a polymeric closure for a package. More specifically, the present invention relates to a polymeric closure that is especially desirable for a package exposed to high-temperature applications such as pasteurization, hot-fill and retort applications.

BACKGROUND OF THE INVENTION

In high-temperature applications such as retort applications, the sterilization chamber can reach and maintain temperatures in excess of 250° F. for a sufficient period of time to ensure that any potentially harmful organisms that may have entered the product are killed. At such high-temperatures, chemical bonding between polymeric surfaces may occur between the closure and the container. Strong bonding, of course, is desirable for creating a robust seal, but can be potentially problematic for a user removing the closure from the container.

In retort applications, traditional closure designs include a three piece system consisting of a contoured metal disc, a donut-shaped plastisol liner and a threaded ring. The closure is used with a container to form a package. In this three piece design, the soft plastisol liner and an exterior surface of the container do not chemically bond to each other. Because there is no chemical bonding between the plastisol liner and the container, the metal disc and the plastisol liner are easily lifted and separated from the container during removal of the closure from the container. This traditional closure design, however, is not as desirable from a cost perspective. It also not desirable from an environmental perspective of the difficulty in recycling.

It would desirable to provide a closure for a package in high-temperature applications that addresses the above-noted disadvantages.

SUMMARY

According to one embodiment, a closure comprises a polymeric top wall portion, a polymeric liner, a polymeric disc and a polymeric annular skirt portion. The polymeric disc is located between the polymeric top wall portion and the polymeric liner. The polymeric annular skirt portion depends from the polymeric top wall portion. The annular skirt portion includes: (1) an internal thread formation for mating engagement with an external thread formation of a container; and (2) an internal prying projection to assist in removing the closure from the container. At least a portion of the internal prying projection is located nearer the polymeric top wall portion than the internal thread formation.

According to another embodiment, a closure comprises a polymeric top wall portion, a polymeric liner, a polymeric disc and a polymeric annular skirt portion. The polymeric disc is located between the polymeric top wall portion and the polymeric liner. The polymeric annular skirt portion depends from the polymeric top wall portion. The annular skirt portion includes: (1) an internal thread formation for mating engagement with an external thread formation of a container; (2) an internal bead to assist in positioning the polymeric liner and the polymeric disc; and (3) an internal prying projection to assist in removing the closure from the container. The internal prying projection is located adjacent to or contacting the internal bead. The internal prying projection extends farther inwardly toward a center of the closure than the internal bead.

According to a further embodiment, a package comprises a container and a closure. The container has a neck portion defining an opening. The container has an external thread formation on the neck portion. The closure is configured for fitment to the neck portion of the container for closing the opening. The closure comprises a polymeric top wall portion, a polymeric liner, a polymeric disc and a polymeric annular skirt portion. The polymeric disc is located between the polymeric top wall portion and the polymeric liner. The polymeric annular skirt portion depends from the polymeric top wall portion. The annular skirt portion includes: (1) an internal thread formation for mating engagement with an external thread formation of a container; and (2) an internal prying projection to assist in removing the closure from the container. At least a portion of the internal prying projection is located nearer the polymeric top wall portion than the internal thread formation.

According to yet another embodiment, a package comprises a container and a closure. The container has a neck portion defining an opening. The container has an external thread formation on the neck portion. The closure is configured for fitment to the neck portion of the container for closing the opening. The closure comprises a polymeric top wall portion, a polymeric liner, a polymeric disc and a polymeric annular skirt portion. The polymeric disc is located between the polymeric top wall portion and the polymeric liner. The polymeric annular skirt portion depends from the polymeric top wall portion. The annular skirt portion includes: (1) an internal thread formation for mating engagement with an external thread formation of a container; (2) an internal bead to assist in positioning the polymeric liner and the polymeric disc; and (3) an internal prying projection to assist in removing the closure from the container. The internal prying projection is located adjacent to or contacting the internal bead. The internal prying projection extends farther inwardly toward a center of the closure than the internal bead.

According to another embodiment, a closure comprises a polymeric top wall portion, a polymeric liner, a polymeric disc, and a polymeric annular skirt portion. The polymeric disc is located between the polymeric top wall portion and the polymeric liner. The polymeric disc includes an external prying projection to assist in removing the closure from a container. The external prying projection extends from one end of the polymeric disc. The polymeric annular skirt portion depends from the polymeric top wall portion. The annular skirt portion includes an internal thread formation for mating engagement with an external thread formation of a container.

According to a further embodiment, a closure comprises a polymeric top wall portion, a polymeric liner, a polymeric disc and a polymeric annular skirt portion. The polymeric liner has a weakened area near or at one end thereof. The weakened area of the polymeric liner reduces the amount of adhesion with a container to assist in removing the closure from a container. The polymeric disc is located between the polymeric top wall portion and the polymeric liner. The polymeric annular skirt portion depends from the polymeric top wall portion. The annular skirt portion includes an internal thread formation for mating engagement with an external thread formation of a container.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
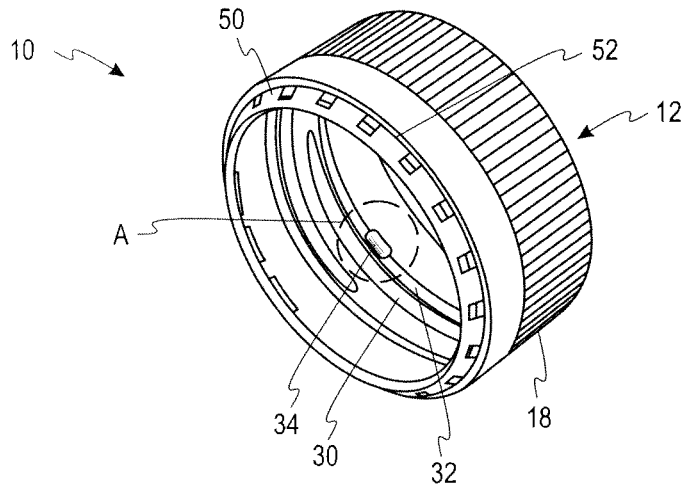
FIG. 1A is a bottom perspective view of a polymeric closure (shown for clarity without a polymeric liner and disc) according to one embodiment of the invention.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
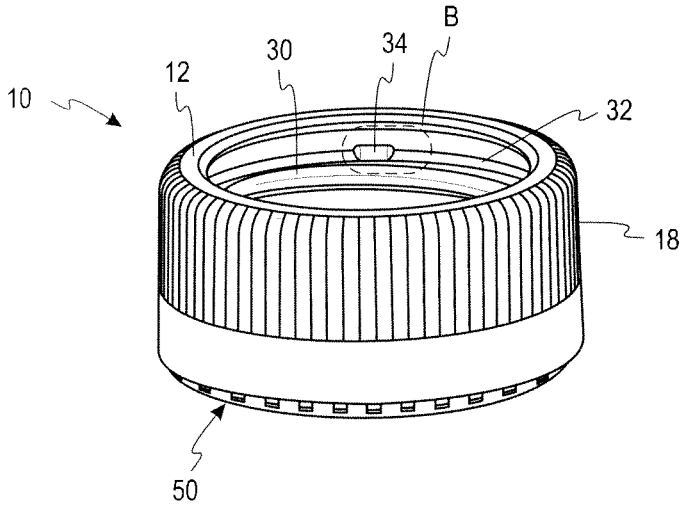
FIG. 1B is a top perspective view of the polymeric closure of FIG. 1A.

FIGS. 1A and 1B illustrate a polymeric closure 10 according to one embodiment of the present invention. For clarity, the polymeric closure in FIGS. 1A and 1B has been shown without a polymeric liner and a polymeric disc. The closures are configured to be placed on a container and form a package.

The polymeric closures of the present invention are especially desirable for a package exposed to high-temperature applications such as pasteurization, hot-fill and retort applications. For example, a retort application may be done at temperatures greater than 250° F. Other non-limiting examples include a hot fill (generally performed at temperatures around 185° F.) or a hot-fill with pasteurization (generally performed at temperatures around 205° F.). It is contemplated that the polymeric closures of the present invention can be used in other high-temperature applications, as well as in other applications that are not high-temperature applications. For example, the polymeric closures of the present invention may be used in other applications using discs in which the disc needs to be separated from a container. One non-limiting example of the disc being separated from a container would be a canning jar application (e.g., a Ball® mason jar).

Figure 2:
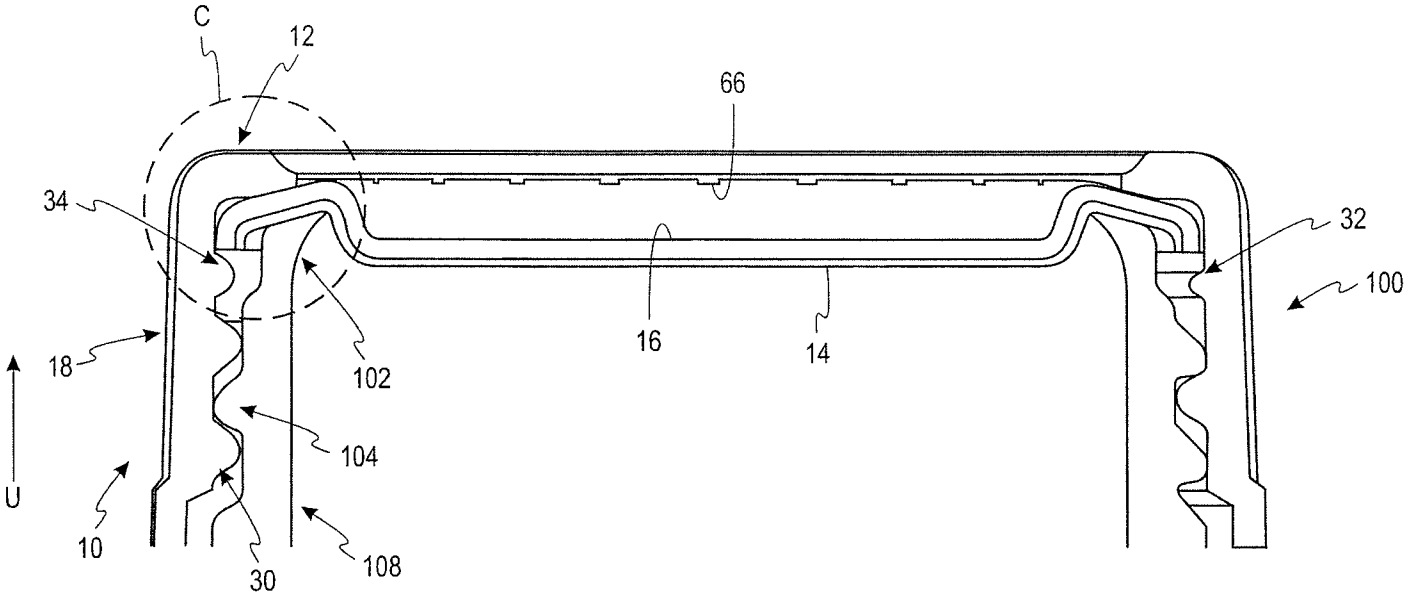
FIG. 2 is a cross-sectional view of the closure of FIGS. 1A and B (including the polymeric liner and disc) in threaded connection with a container according to one embodiment of the invention.

Referring to FIGS. 1A, 1B and 2, a polymeric closure 10 includes a polymeric top wall portion 12, a polymeric liner 14, a polymeric disc 16 and a polymeric annular skirt portion 18 that depends from the polymeric top wall portion 12. The top wall portion 12 is in a donut-shaped configuration. It is contemplated that the top wall portion may extend across the entire top of the closure without any openings. The polymeric disc 16 is located between the polymeric top wall portion 12 and the polymeric liner 14. The polymeric disc 16 of FIG. 2 has a plurality of channels 66 formed therein. The channels 66 allow liquid to travel on the exterior surface of the polymeric disc 16 from a top of the package and between the polymeric annular skirt portion 18 and around the finish of the container.

The polymeric annular skirt portion 18 of FIGS. 1A, 1B and 2 includes an internal thread formation 30, an internal bead 32, and an internal prying projection 34. The internal thread formation 30 is configured for mating engagement with a corresponding external thread formation of a neck portion of a container. The internal thread formation of the closure may include continuous or discontinuous thread segments, and may include single or multiple threads. Thus, it is contemplated that different threads formations may be used in the closure. One non-limited example of an internal thread formation is a helical thread formation.

The internal bead 32 of FIGS. 1A, 1B and 2 assists in maintaining the polymeric disc 16 and the polymeric liner 14 in a proper position within the closure 10. The internal bead 32 extends generally circumferentially around an interior of the closure 10 in a continuous manner. It is contemplated that the internal bead may be discontinuous. It also contemplated that the internal bead may include a plurality of segments.

It is contemplated that the polymeric disc and polymeric liner may maintain their position by mechanisms other than an internal bead such as an internal thread formation that includes multiple threads.

The internal prying projection assists in removing the closure from the neck portion of the container. The internal prying projection is a mechanism for breaking a sealing adhesion formed between the polymeric liner and the container after processing (e.g., high-temperature processing such as retort processing). To assist in removing the closure from a container, at least a portion of the internal prying projection is typically located above the internal thread formation (i.e., closer to the polymeric top wall portion 12).

Referring to FIGS. 1-4, the internal prying projection 34 is located adjacent to or in contact with the internal bead 32. In this embodiment, as best shown in FIG. 2, the internal prying projection 34 extends farther inwardly toward a center of the interior of the closure 10 than the internal bead 32. The internal prying projection 34 assists in separating the seal adhesion between the polymeric portion 14*a* and container surface 108*a* shown in general area 40 (identified with dashed lines in FIG. 5). The internal prying mechanism 34 assists in a concentrated lifting moment (as opposed to a uniform lifting moment) along a generally ledge 42 as shown in FIG. 5. Once the seal release has been initiated by the internal prying projection 34, the rest of the seal between the polymeric liner and the container naturally peels away.

The internal prying projection 34 of FIGS. 1-5 is shown as a single projection. It is contemplated that the closure may include a plurality of internal prying projections to assist in removing the closure from the container. If a plurality of internal prying projections is used, they will typically be located in close proximity with each other to assist in removing the closure from the container. The internal prying projection desirably has an edge surface to assist in a concentrated lifting moment.

Figure 4:
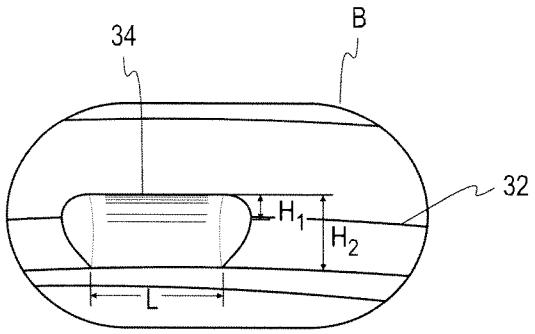
FIG. 4 is an enlarged view of generally circular region B of FIG. 1B.
Figure 3:
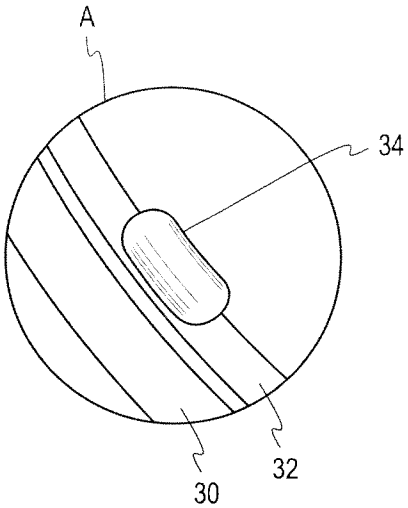
FIG. 3 is an enlarged view of generally circular region A of FIG. 1A.
Figure 5:
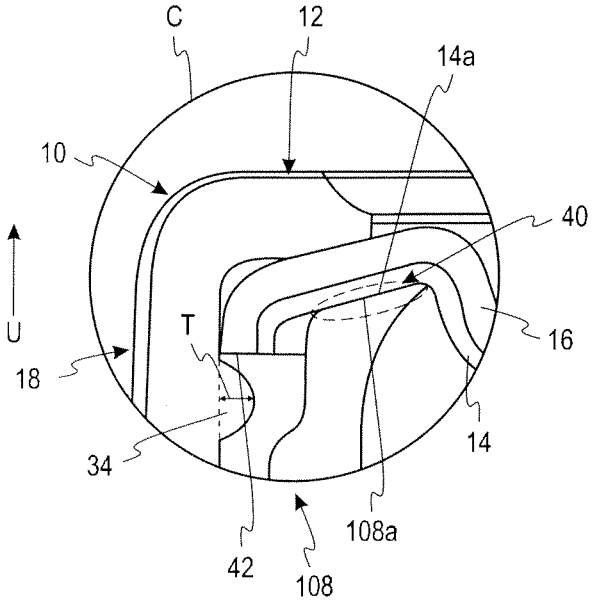
FIG. 5 is an enlarged view of generally circular region C of FIG. 2.

The internal prying projection 34 of FIGS. 1-5 is shown as being generally cylindrical. Referring to FIG. 4, the internal prying projection 34 has a length L that is generally from about 0.06 to about 0.4 inches. The length L may be from about 0.1 to about 0.3 inches and more specifically from about 0.1 to about 0.2 inches. The internal prying projection 34 has a height H2 (total height) that is generally from about 0.04 to about 0.1 inches. The height H2 is typically from 0.04 to about 0.08 inches, and more specifically from about 0.05 to about 0.08 inches. The internal prying projection 34 has a height H1 (height above the internal bead 32) that is generally from about 0.01 to about 0.06 inches. The height H1 is typically from about 0.02 to about 0.06 inches and more specifically from about 0.02 to about 0.04 inches. Thus, the internal prying projection 34 in FIGS. 1-5 extends farther inwardly toward a center of the closure than the internal bead 32. Referring to FIG. 5, the internal prying projection 34 has a thickness T that is generally from about 0.04 to about 0.1 inches. The thickness T may be from about 0.04 to about 0.08 inches, and more specifically from about 0.05 to about 0.08 inches.

It is contemplated that the internal prying projection may be of other shapes and sizes. For example, the internal prying projection may be a cylindrical shape, a generally rectangular or rectangular shape. The internal prying projection may also be a generally trapezoidal or trapezoidal shape.

The closure may also include a polymeric tamper-evident feature. For example, the closure 10 includes a polymeric tamper-evident band 50 (FIGS. 1A, 1B) located at the bottom thereof (i.e., an end opposite of polymeric top wall portion 12). The tamper-evident band 50 depends from and at least partially detachably connected to the annular skirt portion 18 by a frangible connection 52. The tamper-evident band 50 works in conjunction with the container to indicate to a user that the contents of the container may have been accessed. More specifically, the tamper-evident band 50 is designed to separate from the annular skirt portion 18 if a user starts to open the package and gain access to the container.

Figure 6A:
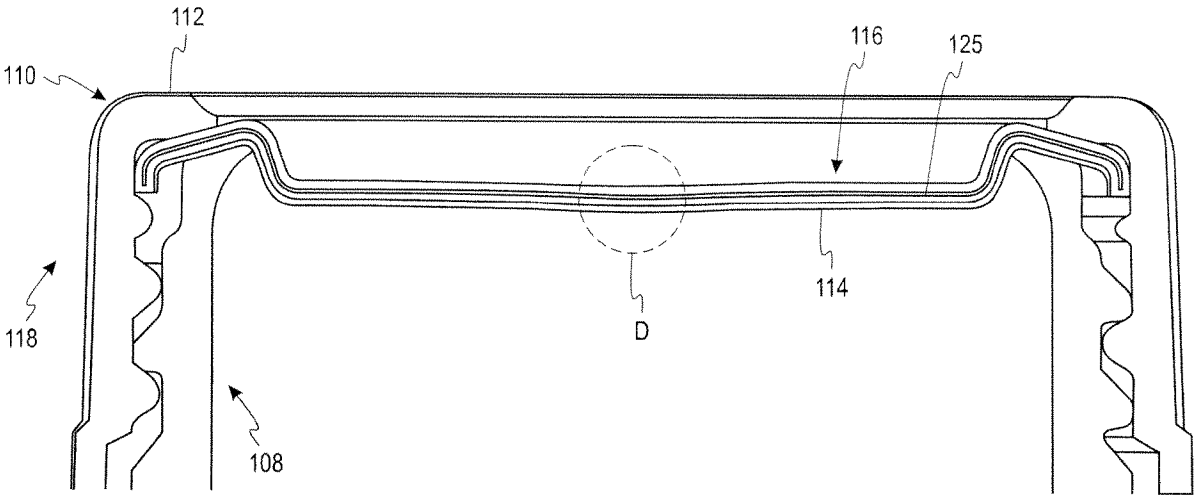
FIG. 6*a* is a partial view of a polymeric disc and liner used in a closure that includes an encapsulated oxygen-barrier layer according to one embodiment of the invention.
Figure 6B:
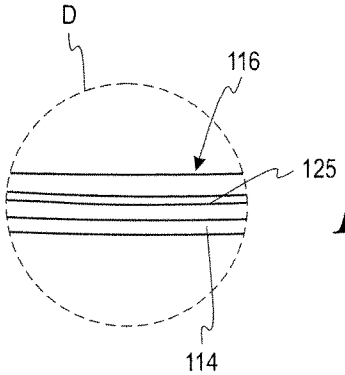
FIG. 6*b* is an enlarged view of generally circular region D of FIG. 6*a*.

The closure 10 may include an oxygen-barrier material. The oxygen-barrier material may be added as a separate layer or may be integrated within a material. For example, referring to FIGS. 6*a* and 6*b*, a closure 110 includes a polymeric disc 116, an oxygen-barrier layer 125 and a polymeric liner 114. The oxygen-barrier layer 125 is encapsulated within the polymeric disc 116. This encapsulation may be performed using a co-extrusion process. Other than the improved oxygen-barrier properties, the polymeric disc 116 and the polymeric liner 114 function in a similar manner as the polymeric disc 16 and the polymeric liner 14, respectively. The closure 110 further includes a polymeric top wall portion 112 and a polymeric annular skirt portion 118, which function in a similar manner as the polymeric top wall portion 12 and the polymeric annular skirt portion 18, respectively. Alternatively, in another embodiment, the oxygen-barrier material may be integrated within the closure. For example, the polymeric disc may further include and be formed with specific oxygen-barrier materials.

The oxygen-barrier layer may be formed by materials that assist in preventing or inhibiting oxygen from entering the container through the closure. These materials may include, but are not limited to, ethylene vinyl alcohol (EVOH). It is contemplated that other oxygen-barrier materials may be used in the closure in the oxygen-barrier layer.

The top wall portion 12 and the annular skirt portion 18 are made of polymeric material. The top wall portion 12 and the annular skirt portion 18 are typically made of polypropylene (PP) or blends including polypropylene. It is contemplated that the top wall portion and the annular skirt portion may be made of other polymeric materials. The tamper-evident band 50, if used, is typically made of the same materials as the top wall portion 12 and the annular skirt portion 18.

The disc 16 is also made of polymeric material. Non-limiting examples of a polymeric material that may be used in forming the disc 16 include polypropylene (PP), polybutylene terephthalate (PBT) or blends thereof. It is contemplated that the disc may be made of other polymeric materials.

The liner 14 is also made of polymeric material. Non-limiting examples of a polymeric material that may be used in forming the liner 14 include thermoplastic elastomer (TPE) or blends thereof. It is contemplated that the liner may be made of other polymeric materials The closures are typically formed by processes such as injection molding, extrusion or the combination thereof.

The closures of the present invention may be used with a container 108 used to form a package 100 of FIG. 2. A portion of the container 108 is shown in FIG. 2 and includes a neck portion 102 that defines an opening. The neck portion 102 of the container 108 includes an external thread formation 104. The external thread formation 104 of the container 108 engages with the corresponding internal thread formation 30 of the closure 10 to seal the package 100. The external thread formation of the container may include continuous or discontinuous thread segments, and may include single or multiple threads. Thus, it is contemplated that different threads formations may be used in the container. One non-limited example of an external thread formation is a helical thread formation.

The container 108 is typically made of polymeric material. One non-limiting example of a material to be used in forming a polymeric container is polypropylene. It is contemplated that the container may be formed of other polymeric materials. The container 108 typically has an encapsulated oxygen-barrier layer or material described above.

To open the container 108 and gain access to the product therein, the closure 10 is unthreaded by turning the closure 10 with respect to the container 108. Initially during the opening process, the internal prying projection 34 first engages the ledge 42 (see FIG. 5). The internal prying projection 34 pushes the polymeric disc 16 (and the attached polymeric liner 14) upwardly (in the direction of arrow U) as viewed with respect to FIGS. 2 and 5. The internal prying projection 34 assists in breaking the seal formed between the polymeric liner 14 and container surface 108*a*. Once the seal release has been initiated by the internal prying projection 34, the rest of the seal between the polymeric liner and the container surface naturally separates as the closure is unthreaded. After the closure has been unthreaded, the closure 10, including the polymeric liner 14 and the polymeric disc 16, is then removed from the container so that the user can gain access to the container. If the tamper-evident band 50 is used, this will be separated from the remainder of the closure 10. The tamper-evident band 50 can remain with the container or be removed in a separate step from the container.

Figure 7:
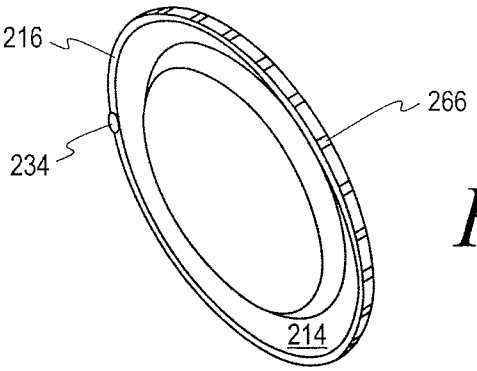
FIG. 7 is a bottom perspective view of a disc with an external prying projection and a liner according to another embodiment of the invention.
Figure 8:
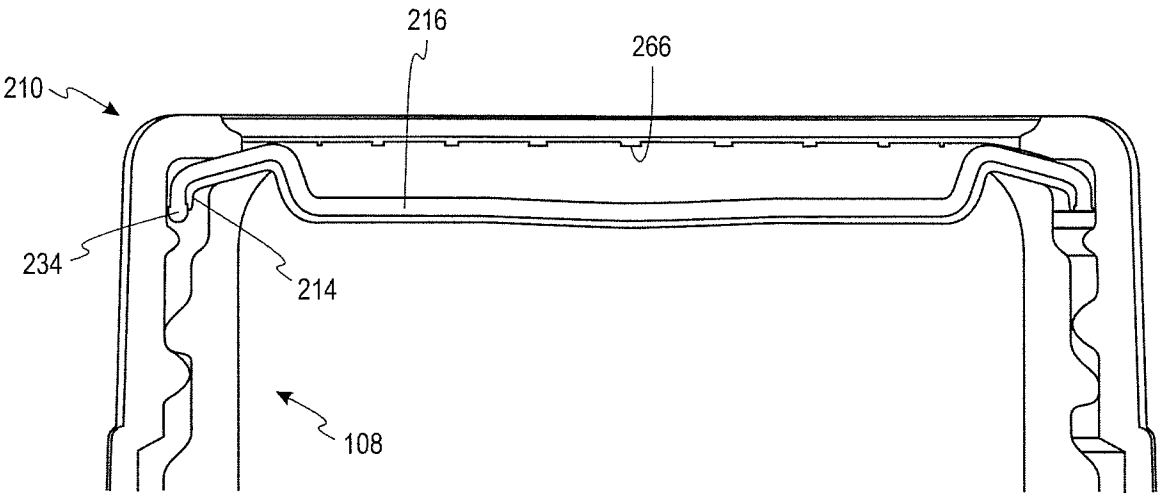
FIG. 8 is a cross-sectional view of a closure using the disc and liner of FIG. 7 in threaded connection with a container according to another embodiment of the invention.

It is contemplated that other prying mechanisms may be used instead of the internal prying projection 34 discussed above. For example, FIGS. 7 and 8 show a closure 210 including a polymeric liner 214 and a polymeric disc 216. The polymeric disc 216 includes a polymeric prying projection 234 located on a bottom edge thereof (as viewed from FIG. 8). The polymeric prying projection 234 functions in a generally similar manner as the internal prying mechanism 34 discussed above. More specifically, as the package is being opened, the polymeric prying projection 234 is contacted by an internal bead or internal thread formation, which causes the prying projection 234 to lift and assist in separating the seal between the liner and the container. This separation continues as the closure is being unthreaded. In this embodiment, the closure 210 further includes the polymeric top-wall portion 12 and the polymeric annular skirt portion 18 discussed above except that the internal prying projection 34 would not be needed.

Figure 9:
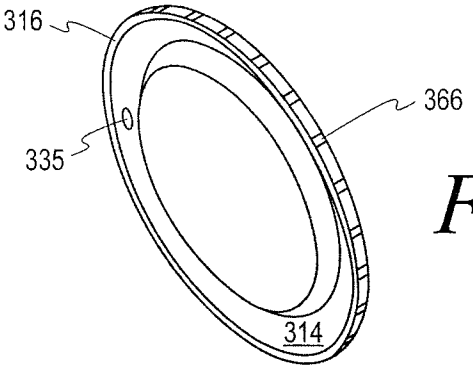
FIG. 9 is a bottom perspective view of a disc and a liner with a weakened area according to a further embodiment of the invention.
Figure 10:
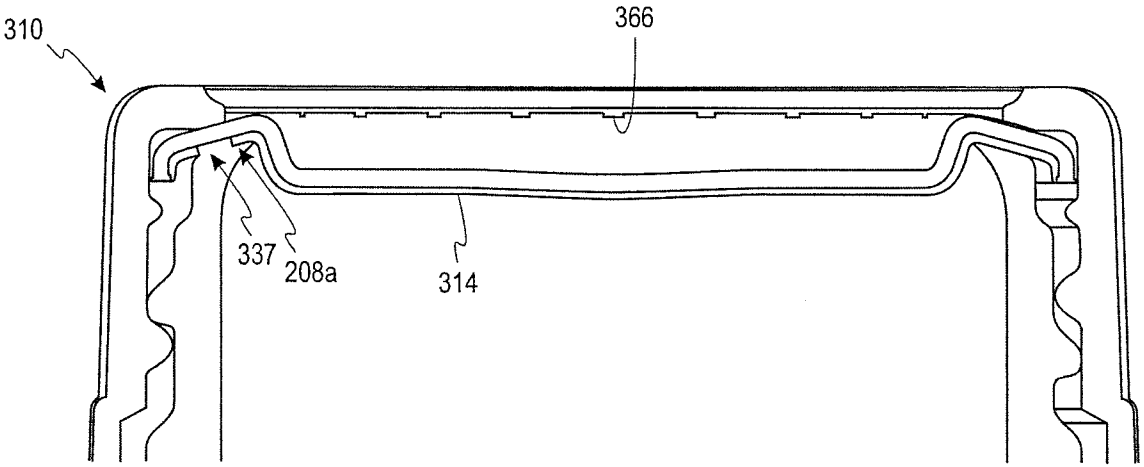
FIG. 10 is a cross-sectional view of a closure using the disc and liner of FIG. 9 in threaded connection with a container according to a further embodiment of the invention.

In another embodiment, FIGS. 9 and 10 show a closure 310 including a polymeric liner 314 and a polymeric disc 316 according to another embodiment. The polymeric liner 314 and the polymeric disc 316 are the same as polymeric liner 14 and polymeric disc 16 discussed above except that the polymeric liner 314 includes a weakened area 335. The weakened area 335 reduces an area of seal adhesion (designated generally as area 337 in FIG. 10). The weakened area 335 may be a complete opening in the liner 314 or may be a reduced thickness of the liner.

The weakened area 335 of the polymeric liner 314 may be used without a polymeric prying projection (such as internal prying projection 34 or polymeric prying projection 234 discussed above). The weakened area 335 is sized and shaped to assist in reducing the amount of seal adhesion between the polymeric liner 314 and the container surface. By reducing the amount of seal adhesion between the polymeric liner and the container surface, it is less likely that the polymeric liner and disc will remain adhered to the container during the removal process of the closure from the container.

EXAMPLES

Inventive and Comparative closures were made and tested. Specifically, the Inventive closure included a polymeric top wall portion (PP), a polymeric liner (TPE), a polymeric disc (PP) and an annular skirt portion (PP) that included an internal prying projection. The configuration of the Inventive closure was substantially similar to the closure 10 of FIG. 1. The Comparative closure was identical to the above described Inventive closure except that the Comparative closure did not include the internal prying projection.

The Inventive and Comparative closures were placed and secured onto respective retort packages. The retort packages were made of PP with an EVOH encapsulated layer therebetween. The packages were placed in a retort test chamber with a temperature of about 250° F. for about 10 minutes having a chamber pressure of 24 psi. Approximately 6 samples of each of the Inventive and Comparative closures were tested. After removal from the retort test chamber, the removal torque of the Inventive and Comparative closures were tested and determined using a Spring Torque Tester (Serial No. 100-2015MRA) distributed by SecurePak.

The results of the tested showed that the Inventive closures surprisingly had an average torque removal of 11.3 inch-pounds less than that of the Comparative closures. Additionally, the Comparative closures failed to remove the polymeric disc from the container 67% of the time (33% pass rate). The Inventive closures, on the other hand, did not fail to remove the disc from the container in any of the samples, resulting in a 100% pass rate (0% failure rate).

What is claimed is:

1. A closure comprising:

a polymeric top wall portion;

a polymeric liner;

a polymeric disc, the polymeric disc being located between the polymeric top wall portion and the polymeric liner; and a polymeric annular skirt portion depending from the polymeric top wall portion, the annular skirt portion including: (1) an internal thread formation for mating engagement with an external thread formation of a container, (2) an internal bead to assist in positioning the polymeric liner and the polymeric disc, and (3) an internal prying projection to assist in removing the closure from the container, the internal prying projection being located adjacent to or contacting the internal bead, the internal prying projection extending farther inwardly toward a center of the closure than the internal bead, wherein at least a portion of each of the internal bead and internal prying projection is located between the polymeric liner and the internal thread formation.

2. The closure of claim 1, wherein the internal prying projection is a single projection.

3. The closure of claim 1, wherein the closure further includes a polymeric tamper-evident feature.

4. The closure of claim 1, wherein the shape of the closure is generally cylindrical.

5. The closure of claim 1, wherein the closure further includes an oxygen-barrier material.

6. The closure of claim 1, wherein the polymeric top wall portion, the polymeric disc and the polymeric annular skirt portion include polypropylene, the polymeric liner including thermoplastic elastomer.

7. The closure of claim 1, wherein the internal projection contacts the internal bead.

8. The closure of claim 1, wherein the internal bead and internal prying projection are located entirely between the polymeric liner and the internal thread formation.

9. A package comprising:

a container having a neck portion defining an opening, the container having an external thread formation on the neck portion; and a closure configured for fitment to the neck portion of the container for closing the opening, the closure including a polymeric top wall portion, a polymeric liner, a polymeric disc and a polymeric annular skirt portion, the polymeric disc being located between the polymeric top wall portion and the polymeric liner, the polymeric annular skirt portion depending from the polymeric top wall portion, the annular skirt portion including: (1) an internal thread formation for mating engagement with the external thread formation of the container, (2) an internal bead to assist in positioning the polymeric liner and the polymeric disc, and (3) an internal prying projection to assist in removing the closure from the container, the internal prying projection being located adjacent to or contacting the internal bead, the internal prying projection extending farther inwardly toward a center of the closure than the internal bead, wherein at least a portion of each of the internal bead and internal prying projection is located between the polymeric liner and the internal thread formation.

10. The package of claim 9, wherein the package is a retort package.

11. The package of claim 9, wherein the package is a hot-fill package.

12. The package of claim 9, wherein the package is a hot-fill with pasteurization package.

13. The package of claim 9, wherein the package is a canning jar.

14. The package of claim 9, wherein the internal projection contacts the internal bead.

15. The package of claim 9, wherein the internal bead and internal prying projection are located entirely between the polymeric liner and the internal thread formation.

16. The package of claim 9, wherein the internal prying projection is a single projection.

17. The package of claim 9, wherein the closure further includes a polymeric tamper-evident feature.

18. The package of claim 9, wherein the polymeric top wall portion, the polymeric disc and the polymeric annular skirt portion include polypropylene, the polymeric liner including thermoplastic elastomer.

19. A closure comprising:

a polymeric top wall portion;

a polymeric liner;

a polymeric disc, the polymeric disc being located between the polymeric top wall portion and the polymeric liner, the polymeric disc including an external prying projection to assist in removing the closure from a container, the external prying projection extending from one end of the polymeric disc, the external prying projection being non-annular; and a polymeric annular skirt portion depending from the polymeric top wall portion, the annular skirt portion including an internal thread formation for mating engagement with an external thread formation of a container.

20. The closure of claim 19, wherein the polymeric annular skirt portion further includes an internal bead to assist in positioning the polymeric liner and the polymeric disc.

21. The closure of claim 19, wherein the external prying projection is a single projection.

22. The closure of claim 19, wherein the closure further includes a polymeric tamper-evident feature.

23. A closure comprising:

a polymeric top wall portion;

a polymeric liner, the polymeric liner having a weakened area near or at one end thereof, the weakened area of the polymeric liner reducing the amount of adhesion with a container to assist in removing the closure from a container;

a polymeric disc, the polymeric disc being located between the polymeric top wall portion and the polymeric liner; and a polymeric annular skirt portion depending from the polymeric top wall portion, the annular skirt portion including an internal thread formation for mating engagement with an external thread formation of a container.

24. The closure of claim 23, wherein the closure further includes a polymeric tamper-evident feature.

* * * * *